US006919170B2

(12) United States Patent
Wan

(10) Patent No.: US 6,919,170 B2
(45) Date of Patent: Jul. 19, 2005

(54) METHOD OF MANUFACTURING A BLEACH COMPOSITION FOR PROCESSING A COLOR PHOTOGRAPHIC MATERIAL

(75) Inventor: Haixing Wan, Ramsey, NJ (US)

(73) Assignee: Fuji Hunt Photographic Chemicals, Inc., Allendale, NJ (US)

( * ) Notice: Subject to any disclaimer, the term of this patent is extended or adjusted under 35 U.S.C. 154(b) by 92 days.

(21) Appl. No.: 10/084,458

(22) Filed: Feb. 28, 2002

(65) Prior Publication Data

US 2003/0165782 A1 Sep. 4, 2003

(51) Int. Cl.[7] ..... G03C 7/42
(52) U.S. Cl. ..... 430/450; 430/393; 430/430
(58) Field of Search ..... 430/450, 393, 430/430; 562/400

(56) References Cited

U.S. PATENT DOCUMENTS 5,093,228 A 3/1992 Nakamura
6,534,253 B1 * 3/2003 Kuykendall et al. ..... 430/393
6,582,893 B2 * 6/2003 Vincent et al. ..... 430/460
2004/0185390 A1 * 9/2004 Vincent et al. ..... 430/393

FOREIGN PATENT DOCUMENTS

DE 3800270 A1 7/1989

OTHER PUBLICATIONS

Research Disclosure, Sep. 1997, pp. 613–650.

* cited by examiner

*Primary Examiner*—Hoa Van Le
(74) *Attorney, Agent, or Firm*—Burns, Doane, Swecker & Mathis, L.L.P.

(57) ABSTRACT

The present invention relates to methods useful for processing a color photographic material. A method of manufacturing a ferric 1,3-PDTA complex is provided. The method includes reacting ferrous bromide with unchelated 1,3-PDTA, thereby forming a ferrous 1,3-PDTA complex; and conducting an oxidation process wherein the ferrous 1,3-PDTA complex is converted to the ferric 1,3-PDTA complex. Also provided is a method of processing a silver halide color photographic material.

15 Claims, No Drawings

METHOD OF MANUFACTURING A BLEACH COMPOSITION FOR PROCESSING A COLOR PHOTOGRAPHIC MATERIAL

BACKGROUND OF THE INVENTION

1. Field of the Invention

The present invention relates in general to color photography and in particular to methods useful for processing a color photographic material. More particularly, the present invention relates to a method of manufacturing a compound useful as a bleaching agent in the processing of a silver halide color photographic material.

2. Description of the Related Art

A process for developing a color photographic material generally includes a color development process and a desilvering process. In the color development process, silver halide exposed to light is reduced with a color developing agent to produce silver and, at the same time, the oxidized color developing agent is reacted with a color former (i.e., a coupler) to form a dye image. In the subsequent desilvering process, the silver produced in the color development process is oxidized with a bleaching agent and dissolved by a silver ion complexing agent commonly called a fixing agent. In general, the desilvering process typically yields a material which has less than about 10 $\mu g/m^2$ of residual silver. The presence of an excessive amount of silver can lead to poor image quality. The desilvering process provides a dye image on the color light-sensitive material (i.e., a color photographic material or color photosensitive material).

The desilvering process typically includes employing a bleaching bath containing a bleach composition and a fixing bath containing a fixing agent. Alternatively or additionally, the desilvering process can include a monobath desilvering step which is carried out by using a bleach-fixing bath which contains both the bleach composition and the fixing agent.

A common process for manufacturing a bleach composition includes mixing ferric nitrate ($Fe(NO_3)_3.9H_2O$), a chelating agent and ammonia. In this process, various nitrate compounds including, for example, ammonium nitrate ($NH_4NO_3$), are typically formed as by-products. The presence of an excess of such nitrate compounds can have an adverse effect on the bleaching rate of the bleach composition, such as an increase in the retention of silver in the photographic silver halide emulsion.

U.S. Pat. No. 5,093,228 discloses a (1,3-diaminopropanetetraacetato)-iron (III) complex salt which is used as a bleaching agent. This bleaching agent can provide advantages such as a high bleaching rate with fast removal of silver. However, due to the relatively high cost of the (1,3-diaminopropanetetraacetato)-iron (III) complex salt, providing a method for the economic manufacture of such compound would be beneficial.

German Patent Document No. 3,800,270 (DE '270) discloses a method for manufacturing a two-component bleaching bath concentrate using ferric bromide ($FeBr_3$) as a reactant. The two components of the bleaching bath concentrate include a $FeBr_3$ aqueous solution and an aqueous solution of an ammonium salt of an aminopolycarboxylic acid. DE '270 discloses that $FeBr_3$ is stable if it is stored in a sealed bottle. The two components are mixed together to form the bleaching bath concentrate.

The method described in DE '270 has several drawbacks. For example, $FeBr_3$ is a highly unstable compound and can decompose when exposed to air, light, heat and the like, as shown in the following equation:

(air, light, heat)

$$2FeBr_3 \rightarrow 2FeBr_2 + Br_2.$$

As such, the storage and transportation conditions of $FeBr_3$ should be carefully maintained and monitored to prevent or reduce the decomposition thereof. In addition, the bleaching bath concentrate of DE '270 does not possess good stability and bleaching characteristics. Such characteristics of the DE '270 bleaching bath concentrate are discussed in greater detail below in the Examples.

In view of the foregoing, it is apparent that a need exists for a method of manufacturing a bleach composition which is cost-effective and which provides a bleach composition possessing good bleaching performance and stability characteristics.

SUMMARY OF THE INVENTION

The present invention provides an advance in the art of a stable, easy-to-manufacture, and cost-effective color photographic bleach composition. An object of the present invention is to provide a method for manufacturing a bleach composition exhibiting fast processing of color photographic materials with a high bleaching rate, low stain, and low levels of retained silver. Another object of the present invention is to provide high-quality photographic images with reduced formation of precipitation within the bleach solution, processing equipment or precipitation adhering to photographic material. These and other objects can be obtained in the inventive methods of manufacturing bleach compositions for processing a color photographic material.

According to one aspect of the present invention, a method of manufacturing a ferric 1,3-propylene diamine tetraacetic acid (1,3-PDTA) complex is provided. The method comprises reacting ferrous bromide with unchelated 1,3-PDTA, thereby forming a ferrous 1,3-PDTA complex. The method also comprises conducting an oxidation process wherein the ferrous (iron (II)) 1,3-PDTA complex is converted to the ferric (iron (III)) 1,3-PDTA complex.

According to another aspect of the present invention, a method of processing a silver halide color photographic material is provided. The method comprises forming a bleach composition containing a bleaching agent by a method comprising the steps of: reacting ferrous bromide with unchelated 1,3-PDTA, thereby forming a ferrous 1,3-PDTA complex, and conducting an oxidation process wherein the ferrous 1,3-PDTA complex is converted to a ferric 1,3-PDTA complex. The method of processing a silver halide color photographic material also comprises contacting the ferric 1,3-PDTA complex with the silver halide color photographic material.

DETAILED DESCRIPTION OF THE PREFERRED EMBODIMENTS OF THE PRESENT INVENTION

The compositions formed from the inventive methods have particular applicability in processes for developing a color photographic material, more particularly a silver halide color photographic material. For example, the composition is suitable for use in a C41 film developing process. However, the inventive methods and compositions formed therefrom are not limited to use in such a process.

According to one aspect, ferrous bromide and unchelated 1,3-PDTA are reacted together. The unchelated 1,3-PDTA and the ferrous bromide are mixed together, preferably in the presence of water. For example, the 1,3-PDTA and the ferrous bromide can be added to deionized water, and the resulting material can be stirred during and/or after the mixing thereof. The initial temperature of the deionized water is preferably between about 20° C. to about 30° C., more preferably at about 25° C. The material preferably is stirred until the contents thereof are mixed thoroughly. The reactants may be mixed together on a batch or continuous basis, preferably on a batch basis.

The unchelated 1,3-PDTA can be provided as a solid or in a liquid. Due to the low solubility of 1,3-PDTA in water, the 1,3-PDTA is typically provided in solid form. According to a preferred embodiment, the molar ratio of (1) the amount of unchelated 1,3-PDTA added, to (2) the iron present in the ferrous bromide, is in the range of from about 1.9:1 to about 0.9:1, more preferably from about 1.2:1 to about 0.9:1, and most preferably about 1.05:1. Although any amount of 1,3-PDTA and ferrous bromide can be used, the molar amount of 1,3-PDTA preferably exceeds the amount of iron present in the ferrous bromide in order to minimize or prevent the presence of free iron ions in the bleach composition. Such free iron ions can form a precipitate in the bleach composition and have an adverse effect on the characteristics of the bleach composition.

Preferably, the bleach composition is also formed by adding a solvent which at least partially dissolves the 1,3-PDTA and enables the 1,3-PDTA to form a salt. For example, the solvent can be added to a mixture of water and 1,3-PDTA prior to the addition of the ferrous bromide. Exemplary solvents which can be used include ammonium hydroxide ($NH_4OH$), potassium hydroxide (KOH), sodium hydroxide (NaOH) and a mixture thereof, more preferably ammonium hydroxide. In an exemplary embodiment, ammonium hydroxide containing 20% ammonia by weight can be used. Use of ammonium hydroxide as a solvent is preferred because it enables the formation of a relatively highly concentrated bleach composition. In addition, the ammonium hydroxide can impart good bleaching characteristics to the resulting bleach composition.

Adding ammonium hydroxide to the material formed from the 1,3-PDTA and the deionized water typically generates high quantities of heat. In order to minimize or prevent the thermal decomposition of the chemicals present in the material, the temperature of the material can be maintained at, for example, about 50° C. or below. A heat exchange device such as a cooling jacket can be used to maintain the material at such a preferred temperature.

The ferrous bromide is preferably added after the 1,3-PDTA and the solvent. However, the materials used to form the bleach composition can be added in any order. For example, in an alternative embodiment, the ferrous bromide, 1,3-PDTA and the solvent are simultaneously added to the deionized water. The ferrous bromide is preferably provided in an aqueous solution. For example, a 34.75% ferrous bromide aqueous solution (which contains 9% iron by weight) is used in the Examples set forth below. Alternatively, the ferrous bromide can be provided in solid form, although solid ferrous bromide can be expensive.

Mixing the unchelated 1,3-PDTA, the ferrous bromide and the solvent yields a material containing a ferrous 1,3-PDTA complex. While not being bound to any particular theory, the following reaction is believed to occur when unchelated 1,3-PDTA, ferrous bromide and ammonium hydroxide are mixed together:

$$Fe(II)Br_2+1,3\text{-}PDTA+4NH_4OH \rightarrow (NH_4)_2[Fe(II)\text{-}PDTA]+2NH_4Br+4H_2O.$$

As discussed above, other solvents can be used instead of or in addition to the ammonium hydroxide. Use of such materials can yield a 1,3-PDTA complex that is different from $(NH_4)_2$[Fe(II)-PDTA].

The oxidation process of the inventive method is effective for converting at least some of the ferrous 1,3-PDTA complex to a ferric 1,3-PDTA complex. Such conversion is significant because ferric 1,3-PDTA can function as a highly effective bleaching agent in a bleach composition, whereas ferrous 1,3-PDTA typically is not an effective bleaching agent. In preferred embodiments of the present invention, the oxidation process can include aerating the material containing the ferrous 1,3-PDTA complex with an oxidizing gas; adding a chemical oxidizer to the material; or the combination thereof. For example, the reaction that occurs during the oxidation process is shown by the following equation:

$$\text{(oxidizing gas and/or chemical oxidizer)}$$

$$[Fe(II)\text{-}PDTA]^{-2} \rightarrow [Fe(III)\text{-}PDTA]^{3\,1\,1}.$$

The material formed from the ferrous bromide, 1,3-PDTA and solvent may already contain an amount of $(NH_4)$[Fe(III)-PDTA] prior to the oxidizing process. For example, the initial amount of $(NH_4)_2$[Fe(II)-PDTA] in the material prior to the oxidation process can depend on whether the material has been exposed to air or any other oxidizing gas. Allowing the material to come to equilibrium in the presence of air typically yields a solution containing at least 80% $(NH_4)_2$[Fe(II)-PDTA] and less than 20% $(NH_4)$[Fe(III)-PDTA]. The $(NH_4)$[Fe(III)-PDTA] that is present is formed from, for example, the oxidization of the $(NH_4)_2$[Fe(II)-PDTA] by air.

Any gas-liquid contacting method may be used to aerate the resulting material with an oxidizing gas such as air. For example, the oxidizing gas can be introduced into the material, preferably by bubbling the oxidizing gas through the material. The aerating process preferably includes producing small air bubbles which migrate through the resulting material for a time effective to at least partially oxidize the ferrous 1,3-PDTA complex present therein. In a preferred embodiment, the oxidizing gas is introduced into the resulting material at or in proximity with the bottom of the container which contains the material. The duration of the aeration process and the flow rate of the gas preferably is set at predetermined values which are sufficient to convert at least about 97% of the ferrous 1,3-PDTA complex to the ferric 1,3-PDTA complex, more preferably at least about a 99% conversion. For example, the aeration process can be conducted for about 4 to about 10 hours at an air flow rate of about 4 to about 10 liters/min, more preferably about 8 liters/min.

The chemical oxidizer can include any material that is capable of oxidizing a ferrous 1,3-PDTA complex and converting same to a ferric 1,3-PDTA complex. For example, the chemical oxidizer preferably includes hydrogen peroxide. The concentration and amount of the chemical oxidizer typically depends on the particular chemical oxidizer(s) that is used. For example, the concentration and amount of chemical oxidizer that is added to the material are set at predetermined values which are sufficient to convert at least about 97% of the ferrous 1,3-PDTA complex to the ferric 1,3-PDTA complex, more preferably at least about a 99% conversion. In an exemplary embodiment, 255 g of a 30% hydrogen peroxide solution can be added to form a 10-liter bleach composition (see, e.g., Sample No. 1-2 in the Examples, set forth below).

The resulting bleach composition preferably contains a ferric 1,3-PDTA iron complex salt in the range of from about 0.05 to about 1.0 mole/liter based on the bleach composition, more preferably from about 0.1 to about 0.6 mole/liter, and most preferably from about 0.2 to about 0.5 mole/liter.

According to one aspect, the saturation concentration of the ferric 1,3-PDTA iron complex salt, i.e., the concentration at which the bleach composition is saturated with the ferric 1,3-PDTA iron complex salt, is about 1.0 mole/liter based on the bleach composition. To minimize or prevent precipitation of the complex in the bleach composition, the concentration of ferric 1,3-PDTA complex salt is preferably at or lower than such saturation concentration. However, in highly concentrated compositions, it is possible to have some complex precipitated in the composition.

Advantageously, the bleach composition formed by the inventive method can avoid the formation of a precipitate, such as an iron-containing precipitate, for relatively long periods of time. As used herein, the term "iron-containing precipitate" preferably does not include precipitate formed from the ferric 1,3-PDTA complex itself. Particular types of iron-containing precipitates such as, for example, ferric hydroxide, can have adverse effects on the stability and/or performance of the bleach composition. In preferred embodiments, the bleach composition does not form an iron-containing precipitate for (1) at least about 24 hours at about room temperature; (2) at least about 2 weeks at about 4° C.; and/or (3) at least about 2 weeks at about 50° C. As used herein, "room temperature" is defined as a temperature from about 20° C. to about 25° C.

Additional chelating agents can be used in the formation of the inventive bleach compositions. For example, the bleaching agent can include an aminopolycarboxylic acid iron (III) complex salt other than 1,3-PDTA such as an iron (III) complex salt of ethylenediaminetetraacetic acid, diethylenetriaminepentaacetic acid, cyclohexanediaminetetraacetic acid and a mixture thereof. Recently, from the standpoint of environmental conservation, alternative, biodegradable bleaching agents have also been proposed and can be used in the inventive formulation. These bleaching agents include those described in U.S. Pat. No. 5,627,015, for example from column 1, line 65 to column 2, line 6, the entire contents of which document are incorporated herein by reference.

In a preferred embodiment, the bleach composition contains a bleaching accelerator which is effective to reduce the amount of the bleach process time. Examples of useful bleaching accelerators are compounds having a mercapto or disulfide group as described in U.S. Pat. No. 3,893,858, West German Patent Document No. 1,290,812, British Patent Document No. 1,138,842, Japanese Patent Document No. 53-95630 and Research Disclosure, No. 17129 (July 1978); thiazolidine derivatives as described in Japanese Patent Document No. 50-140129; thiourea derivatives as described in U.S. Pat. No. 3,706,561; iodides as described in Japanese Patent Document No. 58-16235; polyethylene oxides as described in West German Patent Document No. 2,748,430; and polyamine compounds as described in Japanese Patent Document No. 45-8836, wherein each of the aforementioned documents are incorporated herein by reference. Among the bleach accelerators, mercapto compounds as described in British Patent Document No. 1,138,842 are preferred. The bleaching accelerator is preferably present in an amount from about $1\times10^{-4}$ to about $2\times10^{-2}$ mole/liter based on the bleach composition, more preferably from about $2\times10^{-4}$ to about $1\times10^{-2}$ mole/liter.

The bleach composition can also include a rehalogenating agent including, for example, a bromide compound (e.g., potassium bromide, sodium bromide, ammonium bromide) and/or a chloride compound (e.g., potassium chloride, sodium chloride, and ammonium chloride). Other bleach components may be added to the inventive bleach composition to improve the bleaching characteristics thereof. For example, corrosion inhibitors, biocides and/or buffering agents can be included in the inventive bleach compositions. Such additives are discussed in U.S. Pat. No. 5,093,228 and Research Disclosure, No. 40145 (September 1997), each of which documents are incorporated herein by reference. In a preferred embodiment, the bleach composition is formed by adding maleic acid, succinic acid and/or imidazole.

The bleach composition of the present invention may contain a fixing agent. For example, a thiosulfate, thiocyanate, thiourea, thioether and a mixture thereof can be added to the bleach composition. Examples of thiosulfates include sodium thiosulfate, ammonium thiosulfate, sodium ammonium thiosulfate, potassium thiosulfate and mixtures thereof. Examples of thiocyanates includes sodium thiocyanate, ammonium thiocyanate, potassium thiocyanate and mixtures thereof. Preferably, the fixing agent includes ammonium thiosulfate. In an exemplary embodiment, the fixing agent is present in an amount from about 0.3 to about 3 mole/liter of the bleach composition, more preferably from about 0.5 to about 2 mole/liter.

Advantageously, the bleach composition of the present invention can be provided as a stable single-part composition. That is, due to the good stability characteristics of the inventive bleach composition, it is not necessary to maintain multiple components of the inventive bleach composition separately prior to use. A further advantage of the inventive bleach composition is that it is not required that the composition be used immediately or soon after formation thereof. The stability characteristics of the inventive bleach composition are discussed in greater detail in the Examples, set forth below.

The preferred duration of a desilvering process that employs the inventive bleach composition is from about 5 to about 240 seconds, more preferably from about 15 to about 100 seconds, and most preferably from about 20 to about 50 seconds. The preferred temperature of the desilvering process is generally maintained from about 25° C. to about 50° C., more preferably from about 35° C. to about 45° C., and most preferably at about 38° C.

The silver halide photosensitive material can include, for example, a silver chlorobromide emulsion-coated color paper; a silver bromide emulsion-coated color paper; color auto positive papers; silver iodobromide emulsion-coated color negative films; color reversal films; and color reversal papers. Of these materials, color negative films are preferred for use with the inventive bleach compositions.

The sequence in which the various components are added to form the inventive bleach composition can have a beneficial effect on the characteristics of the bleach composition. In a preferred embodiment, the following steps are taken in sequence: adding deionized water; adding 1,3-PDTA; adding ammonium hydroxide and/or other solvents; adding ferrous bromide solution; and conducting the chemical oxidation process.

After preparation, the bleach composition of the present invention may be used directly for photographic processing or packaged as a bleach concentrate. The bleach concentrate can be used to form a bleaching solution in the working tank of a photographic processor. For example, the bleach concentrate can be diluted in deionized water using a dilution factor such as about 2 to about 15. Advantageously, the bleach concentrate can be used as a single-part concentrate. That is, due to the good stability characteristics of the bleach concentrate, it is generally not necessary to separately maintain multiple components of the bleach concentrate prior to use.

The bleach composition can also be used as a bleach replenisher. In this regard, the effectiveness of the bleach composition in the working tank of a photographic processor typically becomes reduced over time through the normal use thereof. The effectiveness can also be adversely affected by evaporation and/or contamination with emulsion extracts during processing. According to an exemplary embodiment, the bleach composition can be diluted to obtain a bleach replenisher having a pH from about 2.0 to about 6.0. The bleach replenisher can be added on a continuous or batch basis to the working tank to maintain the effectiveness of the bleach composition. For example, the rate of addition of the bleach replenisher is preferably from about 40 ml/$m^2$ to about 2000 ml/$m^2$ based on the amount of processed photosensitive material, more preferably from about 50 ml/$m^2$ to about 1000 ml/$m^2$.

In order to further illustrate the present invention and the advantages thereof, the following specific Examples are given, it being understood that the Examples are intended only as illustrative and are in no way limiting.

EXAMPLES

1. Manufacture of Sample Nos. 1-1 and 1-2

Two exemplary bleach compositions were formed in accordance with the present invention. One bleach composition (Sample No. 1-1) was manufactured using an aeration oxidation process and another bleach composition (Sample No. 1-2) was manufactured using a chemical oxidization process. The stability and the bleaching characteristics of the exemplary bleach compositions were then tested.

Each of Sample Nos. 1-1 and 1-2 was formed using the following procedure. Deionized water in an amount of 3500 ml was added to a 10-liter plastic container (60 cm height× 16 cm diameter). 1,3-PDTA in an amount of 1431 g was added to the container. Next, 1678 g of an ammonia aqueous solution (containing 20% ammonia by weight) was added. 34.75% ferrous bromide solution (containing 9% iron by weight) in an amount of 2787 g was then added. 600 g of maleic acid, 540 g of succinic acid and 300 g of imidazole were subsequently added. The pH of the liquid was then adjusted to 3.50 using acid or an ammonia aqueous solution.

Sample Nos. 1-1 and 1-2 were then subjected to different oxidizing processes. Sample No. 1-1 was subjected to an aeration oxidizing process. The aeration process was carried out by bubbling air into the liquid through ceramic carbonating stones. In this example, two ceramic carbonating stones were used which are available as Item No. 9600 from Zahm & Nagel Co., Inc., located in Holland, N.Y. Each of the ceramic carbonating stones had a length of 9 cm and a diameter of 5 cm. The liquid was aerated for about 4 hours at an air flow rate of 8 L/min. The flow rate was measured using an accucal flowmeter, Item No. GF-651-1250, available from Gilmont Instruments, located in Barrington, Ill.

Sample No. 1-2 was subjected to a chemical oxidizing process by adding 255 g of 30% hydrogen peroxide. The resulting liquid was stirred.

Thereafter, each of Sample Nos. 1-1 and 1-2 was pH-adjusted to a pH of 4.00 using nitric acid or ammonia aqueous solution. Deionized water was then added to each of the resulting liquids to yield 10-liter bleach compositions. Each of the bleach compositions possessed a dark green color and was free of precipitate.

2. Manufacture of Comparative Sample Nos. 2-1, 2-2 and 2-3

Comparative bleach compositions were formed to compare the stability and bleaching characteristics of the inventive bleach compositions with those of the related art. In particular, Sample No. 2-1 was formed by the direct addition of $NH_4$[Fe(III)-PDTA].$H_2O$. The samples of the present invention were tested to see if they had characteristics that are comparable to that of Sample No. 2-1. Sample No. 2-2 was formed using ferric nitrate as the iron source. Sample No. 2-3 was formed using ferric bromide as the iron source, in accordance with German Patent Document No. 3,800,270.

Each of Sample Nos. 2-1, 2-2 and 2-3 had the following characteristics upon formation. The concentration of ferric ammonium PDTA was 0.4491 mole/liter. The molar ratio of 1,3-PDTA:iron was 1.04:1.00. The concentration of ammonium bromide was 0.8981 mole/liter. The pH of the finished bleach composition at 25° C. was 4.00.

A. Manufacture of a Bleach Composition Using $NH_4$[Fe(III)-PDTA].$H_2O$ as a Raw Material (Sample No. 2-1)

Deionized water in an amount of 350 ml was provided. 30.00 g of imidazole were added to the deionized water. 0.5169 moles of maleic acid and 0.4573 moles of succinic acid were then added. $NH_4$[Fe(III)-PDTA].$H_2O$ was then added in an amount of 177.0 g. 87.96 g of ammonium bromide and 5.5 g of 1,3-PDTA were subsequently added. The resulting material was then pH-adjusted with acetic acid or an ammonia aqueous solution to a pH of 4.00 at 25° C. Deionized water was added to yield a 1000 ml solution. Upon completion of the above steps, the solution had a clear dark green color and was free of precipitate.

B. Manufacture of a Bleach Composition Using Ferric Nitrate as the Iron Source (Sample No. 2-2)

Deionized water in an amount of 350 ml was provided. 30.00 g of imidazole were added to the deionized water. 0.5169 moles of maleic acid and 0.4573 moles of succinic acid were then added. 1,3-PDTA was added in an amount of 143.05 g. 167.77 g of an ammonia aqueous solution (20% ammonia by weight) and 265.07 g of ferric nitrate (41% iron by weight) were added. Ammonium bromide in an amount of 87.96 g was then added. The resulting material was pH-adjusted with acetic acid or ammonia aqueous solution to a pH of 4.00 at 25° C. Deionized water was added to yield a 1000 ml solution. Upon completion of the above steps, the solution had a clear dark green color and was free of precipitate.

C. Manufacture of a Bleach Composition Using Ferric Bromide as the Iron Source (Sample No. 2-3)

Deionized water in an amount of 350 ml was provided. 30.00 g of imidazole were added to the deionized water. 0.5169 moles of maleic acid and 0.4573 moles of succinic acid were then added. 1,3-PDTA was added in an amount of 97.02 g. 154.97 g of an ammonia aqueous solution (20% ammonia by weight) and 166.88 g of a 53.02% ferric bromide solution (containing 10% iron by weight) were added. Ammonium bromide in an amount of 87.96 g was then added. $NH_4$[Fe(III)-PDTA].$H_2O$ was added in an amount of 59.23 g. The resulting material was pH-adjusted with acetic acid or ammonia aqueous solution to a pH of 4.00 at 25° C. Deionized water was added to yield a 1000 ml solution. Upon completion of the above steps, the solution had a clear dark green color and was free of precipitate.

3. Comparison of Sample Bleach Compositions

A. Precipitation Tests

Each of the sample bleach compositions was observed for the formation of a precipitate under various conditions. More specifically, each of the sample bleach compositions was (1) stored at room temperature for 24 hours; (2) stored at 4° C. for 2 weeks; and (3) stored at 50° C. for two weeks. The results are shown in the following Table 1:

TABLE 1

Formation of Precipitate Under Various Conditions

| Sample No. | At room T, 24 hours | At 4° C., 2 weeks | At 50° C., 2 weeks |
|---|---|---|---|
| 1-1 | no | no | no |
| 1-2 | no | no | no |
| 2-1 | no | no | no |
| 2-2 | no | no | no |
| 2-3 | yes | yes | yes |

As can be seen from Table 1, a precipitate formed in each of the tests of Sample No. 2-3. The precipitate resembled a red fine powder. As discussed above, precipitation in a bleach composition is highly undesirable because it can lead to the destabilization of the composition and can interfere with processing and emulsion quality. A precipitate did not form in any of the tests of Sample Nos. 1-1, 1-2, 2-1 or 2-2.

B. Bleaching Performance Tests

Commercially-available photographic color negative silver halide photosensitive materials were processed using Samples Nos. 1-1, 2-1, 2-2 and 2-3. The Superia X-TRA 400 film available from Fuji Photo Film Co., Ltd., and the Royal Gold 1000 film available from Eastman Kodak Co., were used in these tests. The processing sequence that was used is set forth in Table 2:

TABLE 2

Sequence of Film-Developing Process

| Step No. | Process Step | Fuji Product No. | Process T (° C.) | Process time (sec) |
|---|---|---|---|---|
| 1 | color develop | N1 | 38.0 ± 0.2 | 185 |
| 2 | bleach | n/a | 38.0 ± 0.2 | 30, 40 |
| 3 | fix 1 | N3-1 | 38.0 ± 0.2 | 50 |
| 4 | fix 2 | N3-2 | 38.0 ± 0.2 | 50 |
| 5 | super rinse | NS | 38.0 ± 0.2 | 30 |
| 6 | stabilize 1 | N4-1 | 38.0 ± 0.2 | 20 |
| 7 | stabilize 2 | N4-2 | 38.0 ± 0.2 | 20 |
| 8 | dry | n/a | 50 | n/a |

Each of the developer tank solution (step no. 1), fixer tank solution (step nos. 2 and 3), rinse tank solution (step no. 5) and stabilizer tank solution (step nos. 6 and 7) was prepared according to the CN-16L Processing Manual, published by Fuji Photo Film Co., Ltd., Ref. No. AF3-910E(EIGI-96.6-HB.3-1), the contents of which document are incorporated herein by reference. Table 2 also sets forth each chemical that was used in steps 1 and 3–7 denoted as a particular Fuji Product number. Sample Nos. 1-1, 2-1, 2-2 and 2-3 were used to form bleach tank solutions in the above process (step no. 2).

The silver removal properties of each of the sample bleach compositions were tested at 30-second and 40-second bleaching intervals using Kodak Royal Gold 1000 film. The exposure condition was set at 8 times that which is normally applied. That is, although the normal degree of exposure is 2 cms for Kodak Royal Gold 1000 film, the degree of exposure used in the instant tests was 16 cms. Increasing the exposure in this manner increased the amount of silver present, thereby facilitating the comparison of silver-removal properties of the sample bleach compositions. The results of these tests are set forth in Table 3:

TABLE 3

Residual Silver Test Results

| Sample No. | Residual Silver from 30 second bleaching process, ($\mu g/m^2$) | Residual Silver from 40 second bleaching process, ($\mu g/m^2$) |
|---|---|---|
| 1-1 | 25.3 | 6.7 |
| 2-1 | 25.3 | 6.6 |
| 2-2 | 37.9 | 13.0 |
| 2-3 | 30.3 | 8.9 |

As can be seen from Table 3, Sample Nos. 1-1 and 2-1 exhibited comparable silver removal properties. This shows that the inventive method is capable of manufacturing a bleach composition (Sample No. 1-1) which exhibits comparable silver removal characteristics to that formed by a much more costly method of using $NH_4$[Fe(III)-PDTA].$H_2O$ as a raw material (Sample No. 2-1). The silver removal characteristics of Sample No. 1 -1 were also significantly improved in comparison with Sample Nos. 2-2 and 2-3 at both the 30-second and 40-second bleaching intervals.

The stain of the films produced by the sample bleach compositions were also tested using Fujicolor Superia X-TRA 400 film (Film A) and Kodak Royal Gold 1000 film (Film B). Data was obtained by taking the average of three strips of each film. The density of blue, green and red colors of the material were measured. In general, a higher density typically leads to an increased amount of bleach fog in the image, which is an undesirable characteristic. The results are set forth in the following Tables 4a, 4b, 4c and 4d:

TABLE 4a

Sample No. 1-1

| Film | blue (density) | green (density) | red (density) |
|---|---|---|---|
| A | 0.979 | 0.751 | 0.327 |
| B | 1.028 | 0.867 | 0.469 |

TABLE 4b

Sample No. 2-1

| Film | blue (density) | green (density) | red (density) |
|---|---|---|---|
| A | 0.979 | 0.750 | 0.328 |
| B | 1.029 | 0.867 | 0.470 |

TABLE 4c

Sample No. 2-2

| Film | blue (density) | green (density) | red (density) |
|---|---|---|---|
| A | 0.980 | 0.752 | 0.326 |
| B | 1.028 | 0.869 | 0.467 |

TABLE 4d

| Sample No. 2-3 | | | |
|---|---|---|---|
| Film | blue (density) | green (density) | red (density) |
| A | 1.019 | 0.776 | 0.341 |
| B | 1.048 | 0.878 | 0.485 |

As can be seen from Tables 4a–4d, Sample Nos. 1-1 and 2-1 exhibited comparable stain properties. This shows that the inventive method is capable of providing a bleach composition (Sample No. 1-1) which has a comparable stain characteristic to that formed by a much more costly method of using $NH_4$[Fe(III)-PDTA].$H_2O$ as a raw material (Sample No. 2-1). Further, Sample No. 1-1 exhibited significantly improved stain characteristics in comparison with Sample No. 2-3 at both the 30-second and 40-second intervals.

While this invention has been described with respect to particular embodiments thereof, it is apparent that numerous other forms and modifications of the invention will be obvious to those skilled in the art. The appended claims and this invention generally should be construed to cover all such obvious forms and modifications which are within the true spirit and scope of the present invention.

What is claimed is:

1. A method of manufacturing a bleach composition comprising a ferric 1,3-propylene diamine tetraacetic acid complex, comprising:

a) reacting ferrous bromide with unchelated 1,3-PDTA, thereby forming a ferrous 1,3-PDTA complex; and b) conducting an oxidation process wherein an amount of the ferrous 1,3-PDTA complex is converted to the ferric 1,3-PDTA complex, wherein the steps a) and b) are conducted before introducing the bleach composition to a color photographic material, and wherein the bleach composition is introduced to the color photographic material at least about 24 hours after the steps a) and b) are conducted.

2. The method of claim 1, wherein the oxidation process comprises aerating the ferrous 1,3-PDTA complex with an oxidizing gas, contacting the ferrous 1,3-PDTA complex with hydrogen peroxide or the combination thereof.

3. The method of claim 2, wherein the oxidation process comprises aerating the ferrous 1,3-PDTA complex with air.

4. The method of claim 1, wherein the bleach composition is in liquid form, and wherein an iron-containing precipitate does not form in the bleach composition for at least about 24 hours at about room temperature.

5. The method of claim 1, wherein the bleach composition is in liquid form, and wherein an iron-containing precipitate does not form in the bleach composition for at least about 2 weeks at about 4° C.

6. The method of claim 1, wherein the bleach composition is in liquid form, and wherein an iron-containing precipitate does not form in the bleach composition for at least about 2 weeks at about 50° C.

7. The method of claim 1, wherein an amount of ferric 1,3-PDTA complex is present prior to the oxidation process.

8. The method of claim 1, wherein the ferrous 1,3-PDTA complex forms a salt.

9. The method of claim 1, wherein the ferric 1,3-PDTA complex forms a salt.

10. The method of claim 9, wherein the ferric 1,3-PDTA complex forms a salt of ammonium, sodium, potassium or a mixture thereof.

11. The method of claim 10, wherein the ferric 1,3-PDTA complex forms an ammonium salt.

12. The method of claim 1, wherein ammonium hydroxide is added to the ferrous 1,3-PDTA complex formed in step (a).

13. The method of claim 1, wherein the oxidation process is effective to convert at least about 97% of the ferrous 1,3-PDTA complex to the ferric 1,3-PDTA complex.

14. The method of claim 13, wherein the oxidation process is effective to convert at least about 99% of the ferrous 1,3-PDTA complex to the ferric 1,3-PDTA complex.

15. The method of claim 1, wherein at least about 80% of the ferric 1,3-PDTA complex in the bleach composition is manufactured by the oxidation process.

* * * * *